US006126401A

United States Patent [19]

Latham

[11] Patent Number: 6,126,401

[45] Date of Patent: Oct. 3, 2000

[54] HYBRID ELECTRIC/HYDRAULIC DRIVE SYSTEM

[75] Inventor: Roy Westlake Latham, Fremont, Calif.

[73] Assignee: Computer Graphics Systems Development Corporation, Mt. View, Calif.

[21] Appl. No.: 09/191,397

[22] Filed: Nov. 12, 1998

Related U.S. Application Data

[60] Provisional application No. 60/096,327, Aug. 12, 1998.

[51] Int. Cl.[7] ..... F04B 49/00; F04B 49/06; F16D 31/02

[52] U.S. Cl. ..... 417/16; 417/44.1; 60/431

[58] Field of Search ..... 417/44.1, 45, 46, 417/16; 91/1; 60/431, 432, 413, 417

[56] References Cited

U.S. PATENT DOCUMENTS

| | | | |
|---|---|---|---|
| 3,583,282 | 6/1971 | Cope | 91/25 |
| 3,774,696 | 11/1973 | Horsch | 172/812 |
| 3,855,791 | 12/1974 | Quinto | 60/380 |
| 3,903,698 | 9/1975 | Gellatly et al. | 60/453 |
| 4,606,709 | 8/1986 | Chisolm | 417/347 |
| 5,141,402 | 8/1992 | Bloomquist | 417/32 |
| 5,144,801 | 9/1992 | Scanderberg | 60/475 |
| 5,481,873 | 1/1996 | Saruwatari | 60/421 |
| 5,743,716 | 4/1998 | Smith | 417/46 |
| 6,005,360 | 12/1999 | Pace | 60/414 |

*Primary Examiner*—Timothy S. Thorpe
*Assistant Examiner*—Michael K. Gray
*Attorney, Agent, or Firm*—Douglas M. Clarkson

[57] ABSTRACT

A hybrid electric hydraulic drive system, having a first cylinder (75) having a left chamber (32) and a right chamber (34) separated by a piston (22). A second cylinder (76) has a single or sole chamber (74) for receiving hydraulic fluid with the second cylinder enclosing a second piston (78). The second cylinder is substantially equal in length to the first cylinder and is rigidly attached to the first cylinder. A pump (14) is fluidly connected to the left chamber (32) by a first fluid passage (16) and is fluidly connected to the right chamber (34) by a second fluid passage (18). A third fluid passage (80) is directly connected to the right chamber (34) and to the sole fluid chamber (74) of the second cylinder (76). A first rod (30) is connected to the piston (22) and a second rod (84) is connected to the second piston (78). The first and second rods are connected by a connecting element so the rods move in unison. The volume of the sole chamber (74) is equal to the volume of the first rod (30) with the total fluid capacity of the system remaining constant during operation. An encoder (36) is electrically connected to a controller (40) which is electrically connected to a servo electric motor (10) which drives the pump (14).

3 Claims, 2 Drawing Sheets

HYBRID ELECTRIC/HYDRAULIC DRIVE SYSTEM

REFERENCE

The information, data and all benefits of provisional application Ser. No. 60/096,327 filed Aug. 12, 1998 are incorporated by reference into this description.

BACKGROUND OF THE INVENTION

The present invention, generally, relates to the field of mechanical drive systems, and, more particularly, to systems which produce linear motion under servomechanism control.

A variety of electromechanical systems use linear actuators to move a load under control. An important application of such systems is for simulator motion bases, in which a simulator cockpit or cab is moved in accordance with motion models of the vehicle being simulated.

There are two traditional methods for providing controlled linear actuation in simulator motion bases and other such systems. One traditional method is to use an electric motor to power a hydraulic pump, then control the flow of hydraulic fluid to a hydraulic piston using an electrically controlled servo valve.

A second method is to use a controlled electric servomotor to drive a ball screw mechanism. Variations of the second method are to use an electric servomotor to drive a gearbox or a system of belts and pulleys and, ultimately, a bell crank that provides a linear motion.

A totally hydraulic system, the first method, provides smooth controllable power, but such a system is complex and has limited efficiency. The hydraulic pump works continuously to maintain the system pressure. Fluid is pumped through a valve set at the operating pressure of the system, and if no motion is developed, the oil is returned to a reservoir at atmospheric pressure. This heats the oil.

In addition, the precision servomechanism valves, required to control the flow to actuating cylinders, require the control system and amplifiers of an electric servo system and the narrow opening of the valve produces a pressure drop with further inefficiency and oil heating. The fluid must be carefully filtered so as to prevent damage to the precision servo control valves.

Pure electric systems, those of the second method, are limited because electric motors tend to produce high torque only at high rotational speeds. Converting high speed rotary motion to low speed linear motion necessitates ball screw, gear box, or pulley-and-bellcrank arrangements.

Ball screws are expensive, tend to provide rough motion, and are prone to wear. Gearbox arrangements are expensive also and are prone to rough motion due to backlash when reversing direction. Pulley arrangements are constrained by the size and the mounting requirements of the pulleys and, therefore, are impractical to fit into many designs.

Other drive mechanisms have been used occasionally, such as linear motors. These tend to be expensive and may have mechanical constraints unsuited to particular applications.

Closed-circuit hydraulic systems, which use hydraulics without the necessity of a reservoir and constant-pressure pump, are known in prior art for achieving coordinated motion. Hydraulic braking systems couple the motion of one cylinder to another, for example.

U.S. Pat. No. 5,018,950 to Reinhart describes a system using a linear electric motor that actuates a hydraulic piston which, in turn, actuates a second hydraulic piston.

OBJECTS AND SUMMARY OF THE INVENTION

It is an object of the present invention to provide a linear motion drive system whereby hydraulic means is used to convert rotary electric power to linear motion.

Briefly, a system that is constructed and arranged according to the present invention uses a reversible hydraulic pump driven by an electric servo motor. A hydraulic cylinder is used with one chamber connected to one side of the pump and the other chamber connected to the other side of the pump. When the servo motor turns the hydraulic pump in one direction, fluid is pumped out of one end of the cylinder into the other, causing the piston and rods in the cylinder to move linearly.

DETAILED DESCRIPTION OF THE INVENTION

Overview

Before describing the system that is constructed and arranged according to the present invention, a general overview may be helpful. The system of the invention uses a reversible hydraulic pump driven by an electric servo motor. A preferred form of the invention uses a double-acting, double-rod hydraulic cylinder with one chamber connected to one side of the pump and the other chamber connected to the other side of the pump. When the servo motor turns the hydraulic pump in one direction, fluid is pumped out of one end of the cylinder into the other, causing the piston and rods in the cylinder to move linearly.

Reversing the servo and pump causes the piston and rods to move in the other direction. A load attached to either or both of the rods is moved thereby relative to the body of the cylinder. An encoder measuring the position of the load feeds a servo controller that compares the position of the load to a control input and drives the servo motor for closed loop positioning.

A double rod cylinder constrains mounting the actuator in certain applications. An alternative two-piston configuration is used for those applications. In either case, the pump flow rate and cylinder diameters are arranged so that the servo motor operates efficiently relative to its torque characteristics.

Details

Figure 1:
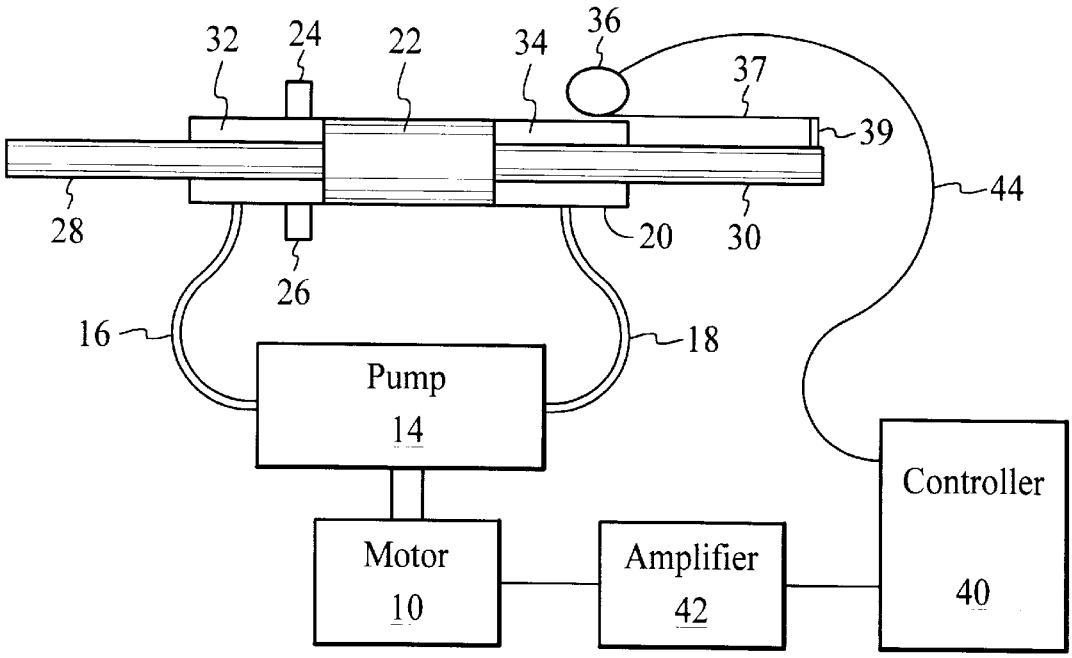
FIG. 1 is an illustration of a preferred embodiment of the present invention.

Referring to FIG. 1, an electric servo motor 10 drives a reversible hydraulic pump 14. The pump 14 is connected to a double-rod hydraulic cylinder 20. A hose or fluid passage 16 connects one side of the pump 14 to the left chamber 32 of the cylinder 20 as seen in this view.

A second hose fluid passage 18 connects the other side of the pump 14 to the right chamber 34 of the cylinder 20. When the pump 14 is turned by the servo motor 10, fluid is pumped from one chamber into the other, depending upon which way the pump 14 is driven.

When fluid is pumped into the left chamber 32, the piston 22 is driven to the right. When the pump 14 is reversed, fluid is pumped into the right chamber 34, and the piston moves to the left. A left rod 28 and a right rod 30 are attached rigidly to this piston 22. A load to be moved relative to the cylinder 20 is attached to the end of either of the two rods, or a load may be attached to each end of both rods 28 and 30.

Linear motion of the loads is relative to the cylinder 20. The cylinder can be attached to the mechanism in which it is employed by various means. Rods 24 and 26 that are attached rigidly to the cylinder 20 can be fitted into bearings in the mechanism to allow the cylinder to pivot.

As fluid is pumped between the two chambers 32 and 34, the total volume of fluid in the system remains constant. This is achieved with a dual-rod cylinder, which is used even if there is a load attached to only one of the two rod ends. In the case of a single load, the rod without a load serves to keep the total fluid volume of the system constant.

The position of the piston 22 and its attached rods 28 and 30 is controlled by an electronic servo controller 40. The servo controller 40 receives an input command signal to position the piston 33 from the system in which the drive system is employed. The controller 40 monitors the current position of the load attached to the piston 22 by receiving an electrical signal from a linear encoder 36 to which the controller 40 is connected by way of wires 44.

The controller 40 compares the current position of the load as measured by the encoder 36 with the currently desired position specified by the received command signal. If the load is further to the right than commanded, the controller 40 will output an analog signal that is amplified by amplifier 42 to drive the electric servo motor 10 in the direction needed to cause the pump 14 to pump fluid from the left chamber 32 to the right chamber 34, thereby causing the piston 22 to move to the left, and with it the load to which it is connected via one of the rods 28 and 30.

If comparison of the current and desired signals indicates that load should be moved to the right, the controller 40 generates the opposite signal to cause the servo motor 10 to turn in the opposite direction and the pump 14 to pump fluid in the opposite direction. If the load is at the desired position, the servo motor is kept in its current position.

Double-rod hydraulic cylinders are available commercially, as are various types of reversible hydraulic pumps. Electric servo motors, amplifiers and controllers, as separate items, are well known in the art. Either an analog or digital controller may be used in the system to provide closed-loop positioning.

If a digital controller is used, a digital linear encoder will be convenient, such as the commercially available "yo-yo" type in which a string or tape unwinds from a spool as the load moves. Encoders are also available built into the hydraulic cylinder.

A shaft encoder could be used on the servo motor 10 to determine load position indirectly. However, this is not preferred because any leakage in the hydraulic pump 14 would reduce the positioning accuracy. When a linear encoder is used on the load, the servo loop will automatically compensate for any leakage by pumping more fluid in the direction required.

For any particular application, the pump 14 capacity and cylinder 20 volume and stroke should be sized to match the torque characteristics of the electric servo motor 10. The pump 14 and the cylinder 20 are taking the place of mechanical gearing used in conventional pure electric systems. The cylinder 20 size can be selected to meet a broad range of applications.

In a closed hydraulic system, there is a potential problem if the fluid heats up and expands. Expanding fluid can cause pressure to build that could break the seals. If there is a little heating, the fluid expansion will be accommodated by expansion in the hoses, with some modest increase in system pressure.

If motion is infrequent, any heating can be ignored. The heating due to pumping will be more substantial for active systems. Sustained high pressure could cause leakage around the seals. Later, when the fluid cools and contracts, the negative pressure might draw air into the system.

One possibility is to select a hydraulic fluid with a sufficiently low temperature coefficient.

Figure 2:
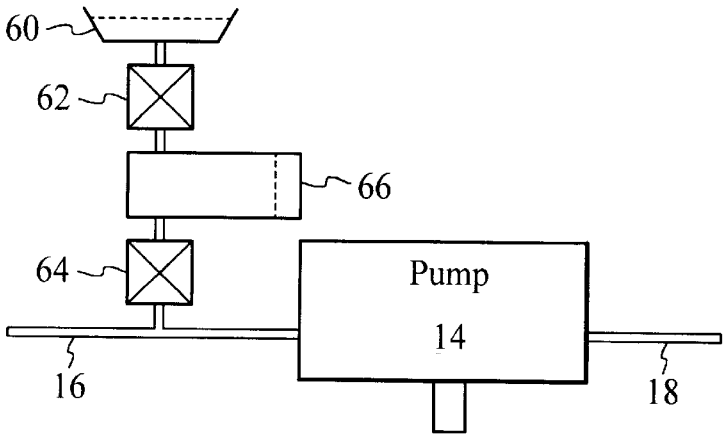
FIG. 2 is an illustration of an arrangement to accommodate any expansion and contraction of the fluid with temperature.

However, with reference to FIG. 2, if it is not practical to select a hydraulic fluid with a needed low temperature coefficient, another possibility is to connect a reservoir of fluid 60 to the system through an electronically controlled on-off valve 64. An accumulator 66 and relief valve 62 can be included, but momentarily assume the relief valve 62 is always open.

The valve 64 and the reservoir 60 would be connected to either side of the pump, say the side on the left end of the actuator. Whenever the pump 14 is pumping to fill the right end of the actuator, the left side pressure should be zero. At that point, the valve 64 can be opened by the controller 40 to add fluid to the system to replace leakage, or, if the oil in the system has expanded, then to allow excess oil to flow into the reservoir.

To keep slight positive pressure in the system, perhaps 25 pounds, a small accumulator 66 with a low pressure relief valve can be placed between the reservoir and the system. Including this accumulator 66 in the system, adds expense, and its only purpose is to help prevent air bubbles from forming by maintaining positive pressure on the seals.

Without the accumulator 66 and relief valve 62, but with the on-off valve 64, the pressure in the system will not go negative when the fluid contracts, and the system is protected when the fluid expands. The valve 64 should be left open when the system is shut down so fluid will be drawn into the system as it cools, working like a water overflow tank on an automobile radiator.

A check valve to the reservoir 60 can readily be connected in parallel wit the valve 64 to ensure that the system pressure never goes negative.

While the system as described offers advantages of simplicity, low cost, and smooth actuation, in some applications the extension of the non-load bearing rod 28 may interfere with the mechanical mounting of the cylinder 20.

Figure 3:
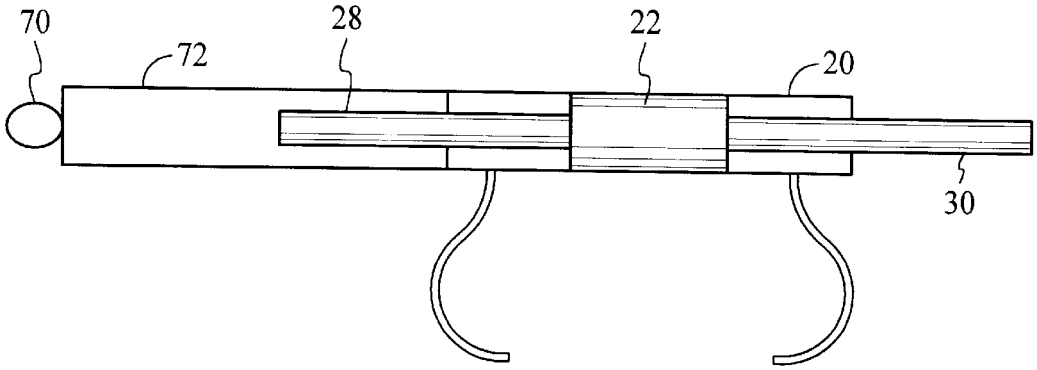
FIG. 3 is an illustration of a dual-rod piston that uses an alternate attachment means.

FIG. 3 of the drawings illustrates an alternative mounting for the cylinder 20 to extend the cylinder 20 with a rigidly attached hollow cylinder 72. Then, an attachment ring 70 can be attached to the end of the hollow cylinder 72. When so modified, the double-rod hydraulic actuator mechanism can be mounted to be as effective operationally as conventional single-rod actuators.

Figure 4:
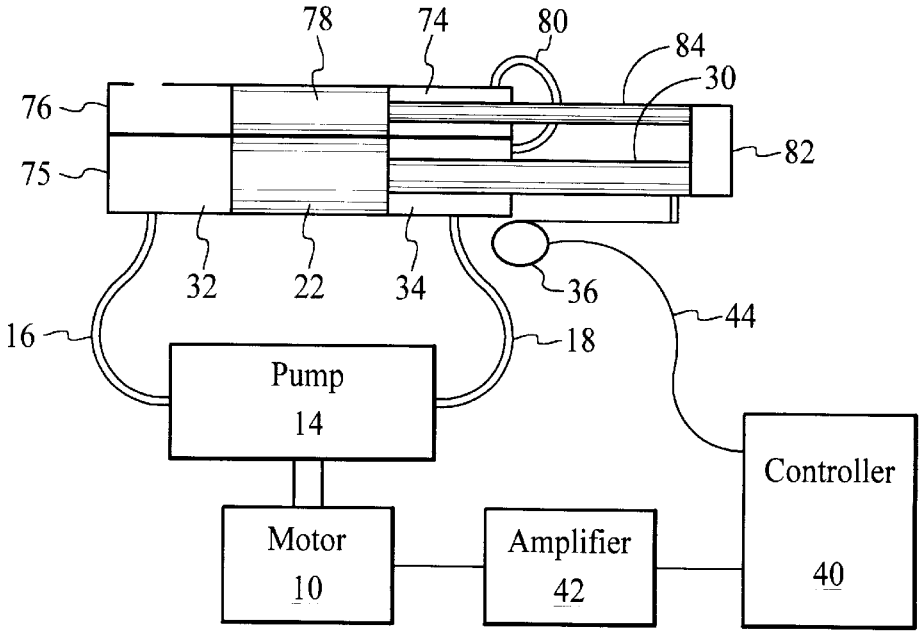
FIG. 4 is an illustration of a dual single-rod piston system arranged in accordance with the principles of the invention.

Referring to FIG. 4, the extra length can add a limitation to the performance of the actuator, which can be avoided by adding a second hydraulic cylinder or compensating cylinder 76 to the first main cylinder 75. In this length-saving configuration, two double-acting single-rod hydraulic cylinders 75 and 76 are rigidly attached in parallel.

The diameters of the rod 84 and of the chamber or sole fluid chamber 74 are selected such that the volume of the right chamber 74 of the second cylinder 76 is equal to the volume of the rod 30 of the first cylinder 75 for all displacements of the rod 30. The ends of the rods 30 and 84 of the two cylinders 76 and 75, respectively, are rigidly attached to each other at 82 by a connecting element so they move in unison.

The cylinder 75 is double-acting, with left and right fluid chambers connected to the rest of the drive system via hoses 16 and 18, as before. The second cylinder 76 with piston 78 is in the style of a double-acting cylinder but with only a single fluid chamber 74 on the right being used. The right chamber 34 of the first cylinder 75 is connected by a hose or fluid passage 80 to the chamber 74 of the second cylinder 76.

For any position of the piston 22 in the first cylinder 75, the fluid added to the system by the chamber 74 is equal to the volume of the rod 30 that is displacing fluid in the chamber 34. Consequently, the total fluid capacity of the system remains constant during operation, as is required for operation of a hydraulic circuit without a reservoir.

Certain details of practical implementations are omitted here, with the understanding that these are well known to the art. These details include the inclusion of bleed screws to purge air from the system, a relief valve for safety from over pressure, and limit detection switches for added safety and reliability.

Otherwise, the invention has been described in substantial detail. It is understood that the invention is not limited by the description, but rather, the invention is intended to include any modification and any arrangement that is covered by the spirit and scope of the appended claims.

What is claimed is:

1. A hybrid electric hydraulic drive system, comprising:

a first hydraulic cylinder having a left chamber and a right chamber separated by a piston;

a second hydraulic cylinder having a sole fluid chamber for receiving hydraulic fluid, said second hydraulic cylinder enclosing a second piston, said second hydraulic cylinder being substantially equal in length to said first hydraulic cylinder and being attached rigidly in parallel thereto;

a pump fluidly connected to said left chamber by a first fluid passage said fluidly connected to said right chamber by a second fluid passage;

a third fluid passage directly connected to said first hydraulic cylinder and to said sole fluid chamber of said second hydraulic cylinder;

a controller;

an electric motor for driving said pump, said electric motor being electrically connected to said controller;

a first rod connected to said piston;

a second rod connected to said second piston;

an encoder, said encoder being electrically connected to said controller;

a connecting element connecting said first rod and said second rod, so said first rod and said second rod move in unison; and wherein said sole chamber has a volume equal to the volume of said first rod, said first rod displacing fluid in said right chamber of said first hydraulic cylinder.

2. A system according to claim 1, wherein:

the total fluid capacity of the system remains constant during operation.

3. The system of claim 2, wherein:

said third fluid passage fluidly connects said right chamber with said sole fluid chamber.

* * * * *